US005551696A

United States Patent [19]

Izett et al.

[11] Patent Number: 5,551,696

[45] **Date of Patent: * Sep. 3, 1996**

[54] TWO-SHAFTED GOLF PUTTER CLUB AND METHOD FOR USING SAME

[76] Inventors: George G. Izett, 2538 Haverford Ave., Ardmore, Pa. 19003; Jay Ciccarone, 668 Woodland Ave., Pottstown, Pa. 19464

[ * ] Notice: The term of this patent shall not extend beyond the expiration date of Pat. No. 5,547,196.

[21] Appl. No.: 425,574

[22] Filed: Apr. 20, 1995

Related U.S. Application Data

[63] Continuation-in-part of Ser. No. 313,732, Sep. 27, 1994, abandoned.

[51] Int. Cl.[6] ..... A63B 69/36

[52] U.S. Cl. ..... 473/226; 473/219; 473/409

[58] Field of Search ..... 273/167 H, 80 C, 273/81 C, 81.3, 167 A; 473/294, 299, 313, 251, 242, 307

[56] References Cited

U.S. PATENT DOCUMENTS

| | | |
|---|---|---|
| 792,631 | 6/1905 | Taylor . |
| 1,919,221 | 10/1931 | Janes . |
| 2,204,974 | 9/1938 | Strasser . |
| 3,529,826 | 8/1967 | Hulyk . |
| 4,140,318 | 2/1979 | Izett et al. . |
| 4,215,860 | 8/1980 | Nakamatsu . |
| 4,754,978 | 7/1988 | Dworacek . |
| 5,037,103 | 8/1991 | Williams et al. . |
| 5,209,475 | 5/1993 | Loman . |
| 5,308,073 | 5/1994 | McKoon et al. . |

FOREIGN PATENT DOCUMENTS

| | | |
|---|---|---|
| 0238646 | 10/1960 | Australia . |
| 52-23431 | 2/1977 | Japan . |

*Primary Examiner*—Mark S. Graham
*Attorney, Agent, or Firm*—Reed Smith Shaw & McClay

[57] ABSTRACT

A golf putter club for training a golfer to repeatedly putt using a constant putting stroke and a method for using the same. The constant putting stroke is defined by the movement of the shoulders of the golfer in a pendulum motion. A putter head body having a heel, a top and a ball striking face is provided. A connecting neck is affixed to the top of the putter head body and rigidly couples first and second hosels to the top of the putter head body. The first hosel has a first proximate end attached to the neck and a second opposing end sized and configured to rigidly hold a connecting end of a first shaft in a fixed position relative to the putter head body. The second hosel has a first proximate end attached to the neck and a second opposing end sized and configured to rigidly hold a connecting end of a second shaft in a fixed position relative to the putter head body. The first and second hosels are angled relative to each other such that the first and second shafts extend therefrom with a desired angle that helps train the golfer to repeatedly putt using the constant putting stroke when the first and second shafts are simultaneously and respectively gripped by the first and second hands of the golfer. The desired angle is less than 180 degrees and remains fixed during the putting stroke.

13 Claims, 15 Drawing Sheets

TWO-SHAFTED GOLF PUTTER CLUB AND METHOD FOR USING SAME

CROSS-REFERENCE TO RELATED APPLICATION

The present application is a continuation-in-part of U.S. patent application No. 08/313,732 entitled "Golf Putter Head and Club", filed Sep. 27, 1994, abandoned, the contents of which are incorporated herein in their entirety by reference.

FIELD OF THE INVENTION

In general, this invention relates to putters and wedges used in the game of golf and, more specifically, to golf clubs which may be used to train and assist a golfer in the development and maintenance of a desirable and repeatable golf stroke.

BACKGROUND OF THE INVENTION

The ability to putt and chip a golf ball with consistent accuracy flows from the use of the proper form in the golfer's swing. It is preferable, if not essential, for golfers to learn to stroke the golf club by the use of, primarily, their shoulders. Excessive use of the golfer's wrists in the stroke, in many instances, causes the club head to approach and come into contact with the golf ball in a manner which results in pushing, pulling and other undesirable movement or paths as the club head approaches the ball, at impact, and as the golfer follows through. It is therefore desirable for beginning golfers to develop putting and chipping swings primarily driven by movement of the golfer's shoulders in a pendulum motion. For intermediate and advanced golfers, it is desirable to continue to practice and maintain a proper shoulder driven swing.

Although some prior art devices developed to date appear to assist in the development and maintenance of a proper putting stroke, many shortcomings still exist. For instance, many of the prior art putting clubs are made with specialized club shafts. Such shafts tend to add to the overall cost of the club by, for instance, adding to the difficulty and cost of manufacturing it. This cost is increased when the club incorporates two specialized shafts.

In addition, since such clubs are typically designed to be used by a golfer of a specific shoulder size and height, the same club may not be comfortably used by a different golfer. When training and trying to develop an acceptable level of consistency in his or her swing, and in order to maintain the proper swing, the golfer preferably uses a club sized and configured for the most comfort and the most desirable feel. The club of choice is usually sized for golfers of a certain physique (i.e., configured to be most comfortably used by a golfer with a particular shoulder breadth, arm length and height). Since the typical club is not adjustable, however, clubs of a number of different sizes and configurations must be made to meet the needs of golfers with different physiques.

Different sizes and configurations of a training club may also be desired by an individual golfer for his or her own use. A change in the desired size or configuration typically requires the golfer to use a different club because the typical training club has no means of adjustment. For instance, when a golfer who has been practicing his or her "shoulder stroke" with a two-shafted training putter club with hand grips 12" apart desires to move from that configuration to a practice position with hand grips 6" apart (i.e., in an effort to gradually move to a one-shafted putter club after learning and maintaining the proper "shoulder stroke"), a typical problem arises. There is typically no means of reducing, for example, the space between the hand grips from 12" to 6". Even if there is a similar club available with 6" spacing, along with the additional club comes the additional cost of using more than one club to achieve the desired feel of gradually decreasing the space between the golfer's hand grips.

One possible means of decreasing production and related costs is to, where possible, use conventional golf club components (e.g., the mere use of conventional shafts with special club heads would minimize the production costs). If the club head was the only specialized component, in addition to reducing production costs, the specialized head could be made available to golf club suppliers and golfers who wish to reduce their overall cost by purchasing only specialized heads and connecting them to components to which they have ready access. Many of the prior art clubs, however, require the use of specialized components for the club shafts, heads and other elements.

OBJECTS OF THE INVENTION

It is therefore an object of the present invention to provide golfers and teaching professionals with training putters and pitching wedges which assist in the teaching, development and maintenance of desirable and repeatable putting and chipping swings.

Another object of the present invention is to provide a golf training club that may be used by a variety of golfers with differing comfort configurations.

Yet another object of the present invention is to provide a golf putter club head which, when connected to two shafts, allows for adjustment of the space between the hand grips at the end of shafts.

An additional object of the present invention is to provide golf putter and wedge club heads that may be used with conventional golf club shafts.

Still another aspect of the present invention is to provide golf putter and wedge club heads that are relatively inexpensive to manufacture.

The foregoing specific objects and advantages of the invention are illustrative of those which can be achieved by the present invention and are not intended to be exhaustive or limiting of the possible advantages which can be realized. Thus, these and other objects and advantages of the invention will be apparent from the description herein or can be learned from practicing the invention, both as embodied herein or as modified in view of any variations which may be apparent to those skilled in the art. Accordingly, the present invention resides in the novel parts, constructions, arrangements, combinations and improvements herein shown and described.

SUMMARY OF THE INVENTION

The present invention is directed to a golf putter club for training a golfer to repeatedly putt using a constant putting stroke and a method for using the same. The constant putting stroke is defined by the movement of the shoulders of the golfer in a pendulum motion. A putter head body having a heel, a top and a ball striking face is provided. A connecting neck is affixed to the top of the putter head body and rigidly couples first and second hosels to the top of the putter head body. The first hosel has a first proximate end attached to the neck and a second opposing end sized and configured to rigidly hold a connecting end of a first shaft in a fixed position relative to the putter head body. The second hosel has a first proximate end attached to the neck and a second opposing end sized and configured to rigidly hold a connecting end of a second shaft in a fixed position relative to the putter head body. The first and second hosels are angled relative to each other such that the first and second shafts extend therefrom with a desired angle that helps train the golfer to repeatedly putt using the constant putting stroke when the first and second shafts are simultaneously and respectively gripped by the first and second hands of the golfer. The desired angle is less than 180 degrees and remains fixed during the putting stroke.

In accordance with a further aspect, the present invention is directed to a golf pitching wedge for training a golfer to repeatedly swing the wedge using a constant chipping swing and a method for using the same. The constant chipping swing is defined by the movement of the shoulders of the golfer in a pendulum motion. A wedge-shaped club head having a top and a ball striking face is provided. A first hosel has a first end coupled to the top of the club head and a second end for rigidly holding a connecting end of a first shaft in a fixed position relative to the club head. A second hosel has a first end coupled to the top of the club head and a second end for rigidly holding a connecting end of a second shaft in a fixed position relative to the club head. The first and second hosels are angled relative to each other such that the first and second shafts extend therefrom with a desired angle that helps the golfer to repeatedly swing using the constant chipping swing when the first and second shafts are simultaneously and respectively gripped by the first and second hands of the golfer. The desired angle is less than 180 degrees and remains fixed during the pitching swing.

In accordance with a still further aspect, the present invention is directed to a golf club for striking a golf ball lying on a playing surface using a golf swing defined by movement of a golfer's shoulders in a pendulum motion. A golf club head having a top and a ball striking face is provided. A hosel with a first end coupled to the top of the head and a second end for rigidly holding a connecting end of a shaft in a fixed position relative to the golf club head is also provided. A grip is affixed to the shaft for grasping with the golfer's hands the club during the golf swing. The shaft is angled relative to the ball striking face such that the golfer's hands are positioned in front of an imaginary plane when the ball striking face impacts the golf ball during the golf swing. The imaginary plane passes through the golf ball perpendicular to the playing surface, and is perpendicular to a reference line passing through the golfer's shoulders.

BRIEF DESCRIPTION OF THE DRAWINGS

There are seen in the drawings forms of the present invention which are preferred and which represent the best mode presently contemplated for carrying out the invention. It should be understood, however, that the invention is not limited to the precise arrangements and instrumentalities shown.

DETAILED DESCRIPTION OF THE PREFERRED EMBODIMENTS

Figure 1:
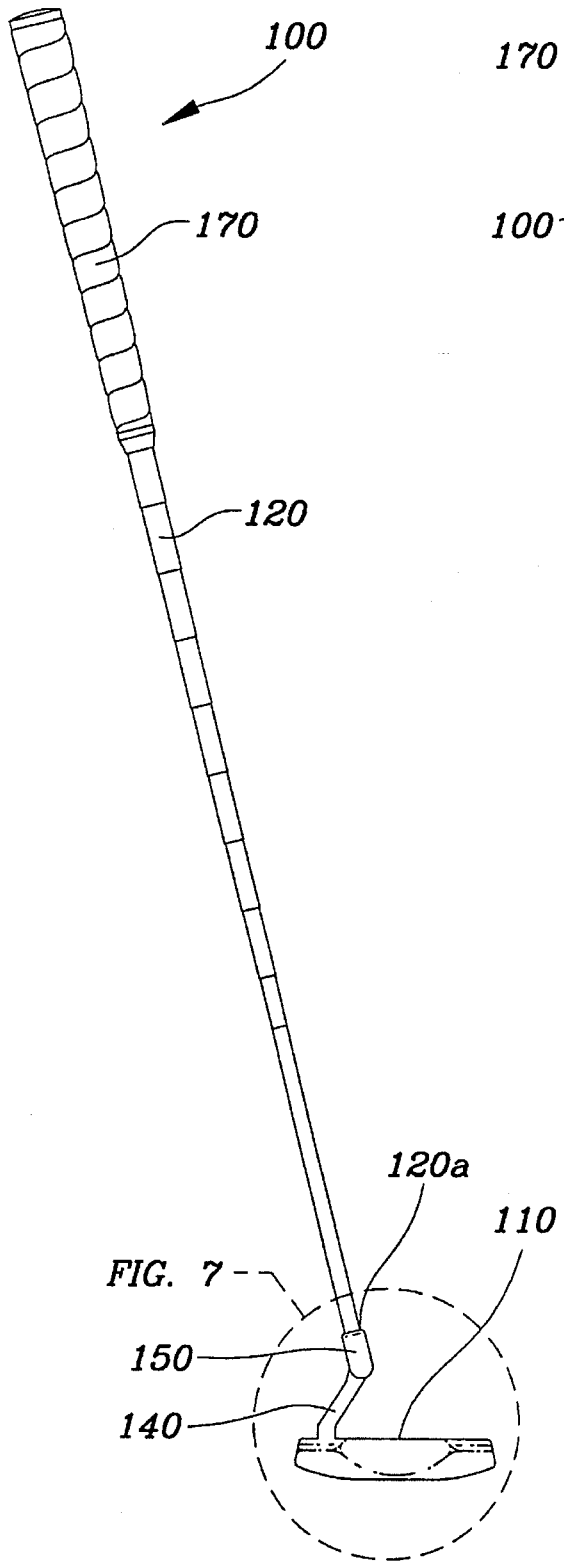
FIG. 1 is a side view of a two-shafted putter club in accordance with a preferred embodiment of the present invention.
Figure 2:
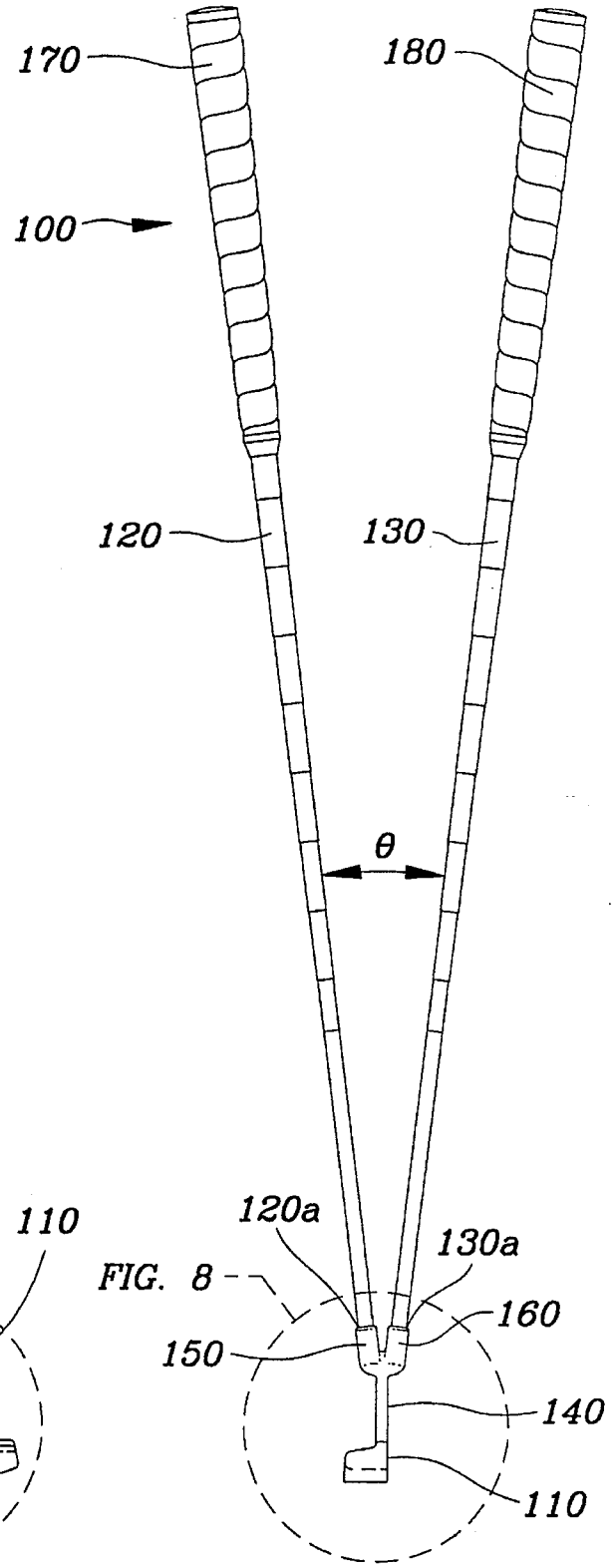
FIG. 2 is a front view of a two-shafted putter club in accordance with a preferred embodiment of the present invention.
Figure 3:
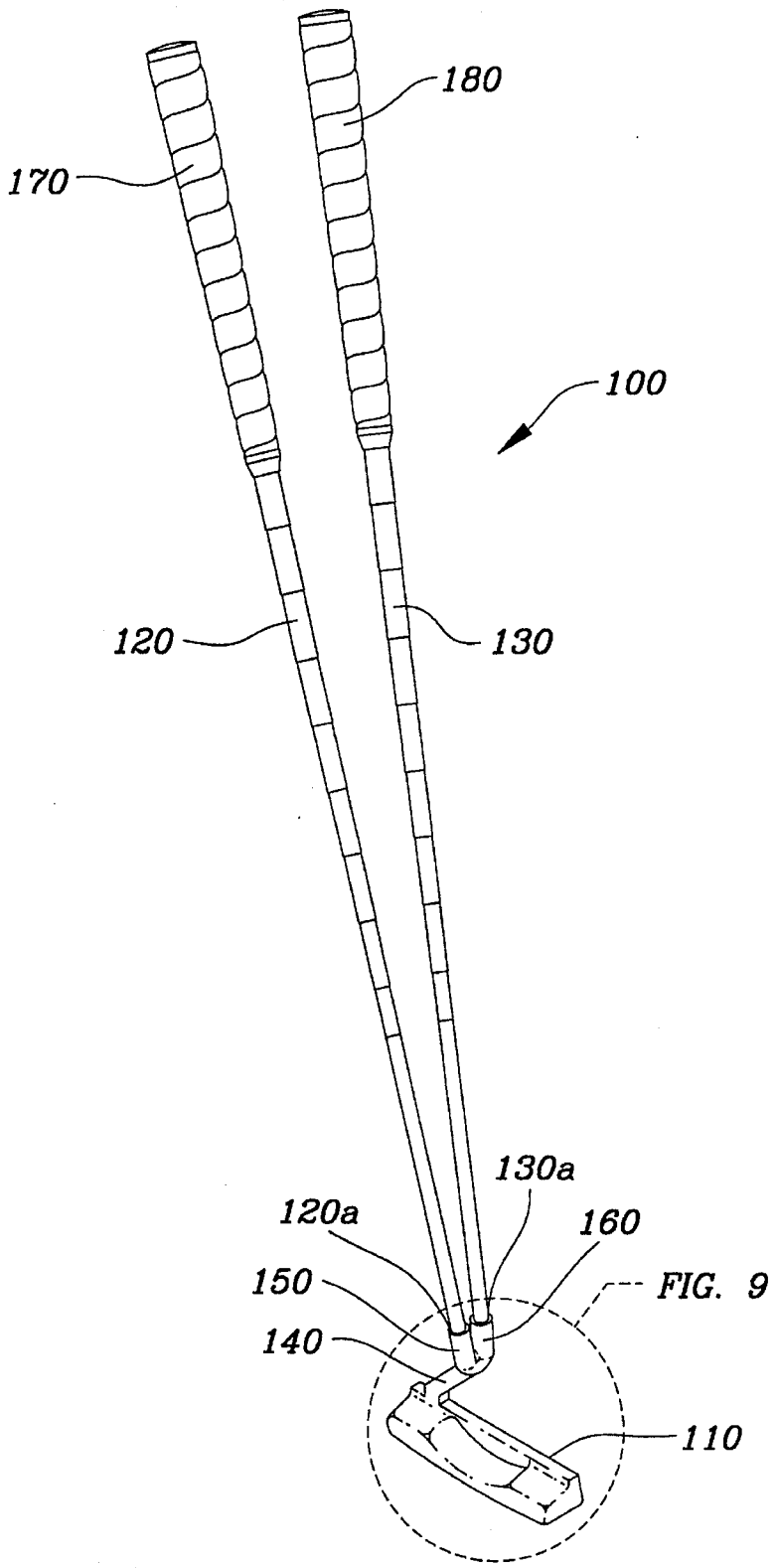
FIG. 3 is an isometric view of a two-shafted putter club in accordance with a preferred embodiment of the present invention.

Referring now to FIGS. 1, 2 and 3, there are shown side, front and isometric views, respectively, of a two-shafted putter club 100 in accordance with a preferred embodiment of the present invention. Putter club 100 is formed of a putter club head 110, and a pair of golf club shafts 120, 130. Shafts 120 and 130 are preferably formed, for example, of conventional, flexible golf club shafts, although unconventional or specialized (e.g., curved) shafts may be used in conjunction with the present invention. A singular neck 140 is rigidly affixed to the top side of the putter club head 110. A pair of hosels 150, 160 are rigidly affixed to an upper portion of neck 140. Hosel 150 is configured to rigidly hold a connecting end 120*a* of shaft 120 in a fixed position relative to putter club head 110. Similarly, hosel 160 is configured to rigidly hold a connecting end 130*a* of shaft 130 in a fixed position relative to putter club head 110. Hosels 150 and 160 are affixed to neck 140 in an angular position relative to each other such that shafts 120, 130 extend from hosels 150, 160 at a desired angle theta. The desired angle is preferably in the range of 5–30 degrees and, still more preferably, the desired angle will be approximately 14 degrees.

Grips 170, 180 are attached to the ends of shafts 120, 130, respectively. During the use of two-shafted putter club 100, a golfer simultaneously grasps grip 170 with one hand and grip 180 with the other hand. The golfer then swings putter club 100 in a pendulum motion. The preferred pendulum motion is described more fully in connection with FIG. 14. During the pendulum putting stroke, the angle theta between shafts 120, 130 remains fixed. It was found that, by repeatedly practicing a putting stroke with putter club 100, a golfer is able to develop and maintain a constant pendulum putting swing. Thus, as explained more fully below, a golfer may use two-shafted putter club 100 as a training device in order to develop a putting stroke which the golfer may then use in putting with a single-shafted putter club. In addition, if a two-shafted putter club such as club 100 was approved for regulation play by, for example, the U.S. Golf Association, a golfer could use putter club 100 for regulation play as well as for training purposes. In the event putter club 100 was used for regulation play (as opposed to training), shafts 120, 130 would preferably be rigid (and not flexible) shafts.

Figure 8:
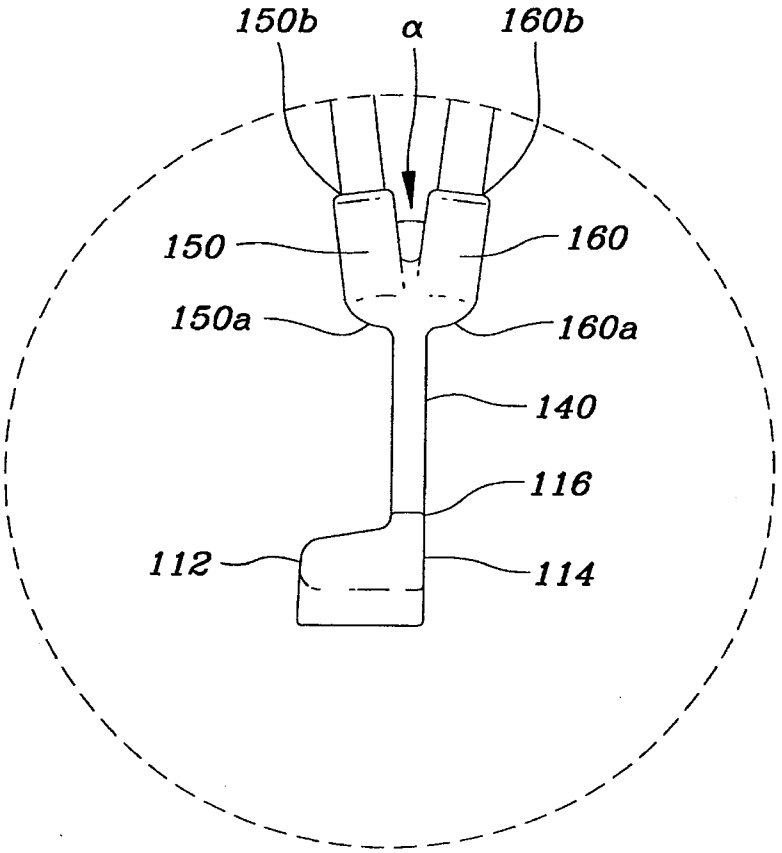
FIG. 8 is an expanded view of the putter club head shown in FIG. 2.
Figure 7:
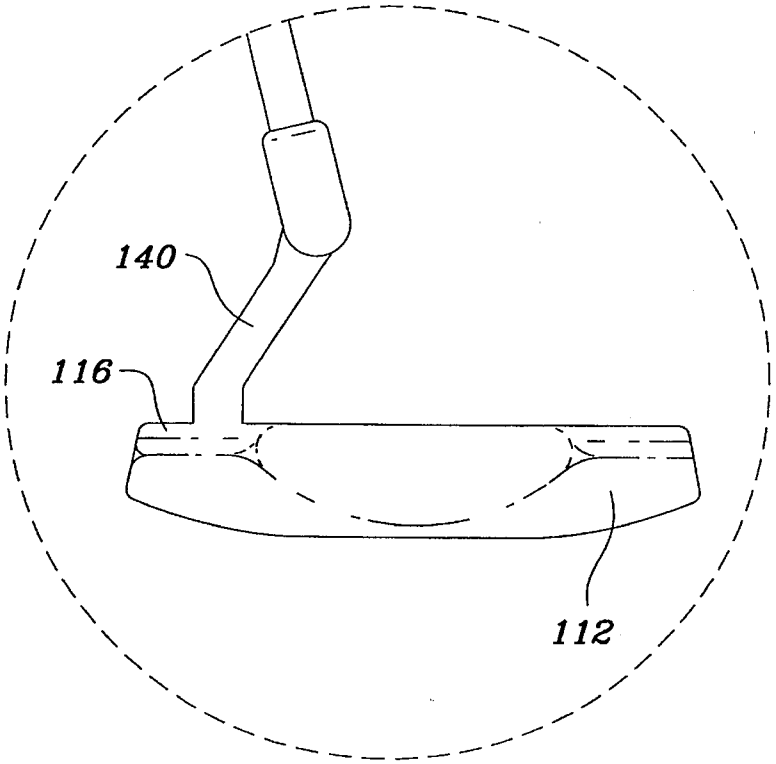
FIG. 7 is an expanded view of the putter club head shown in FIG. 1.
Figure 9:
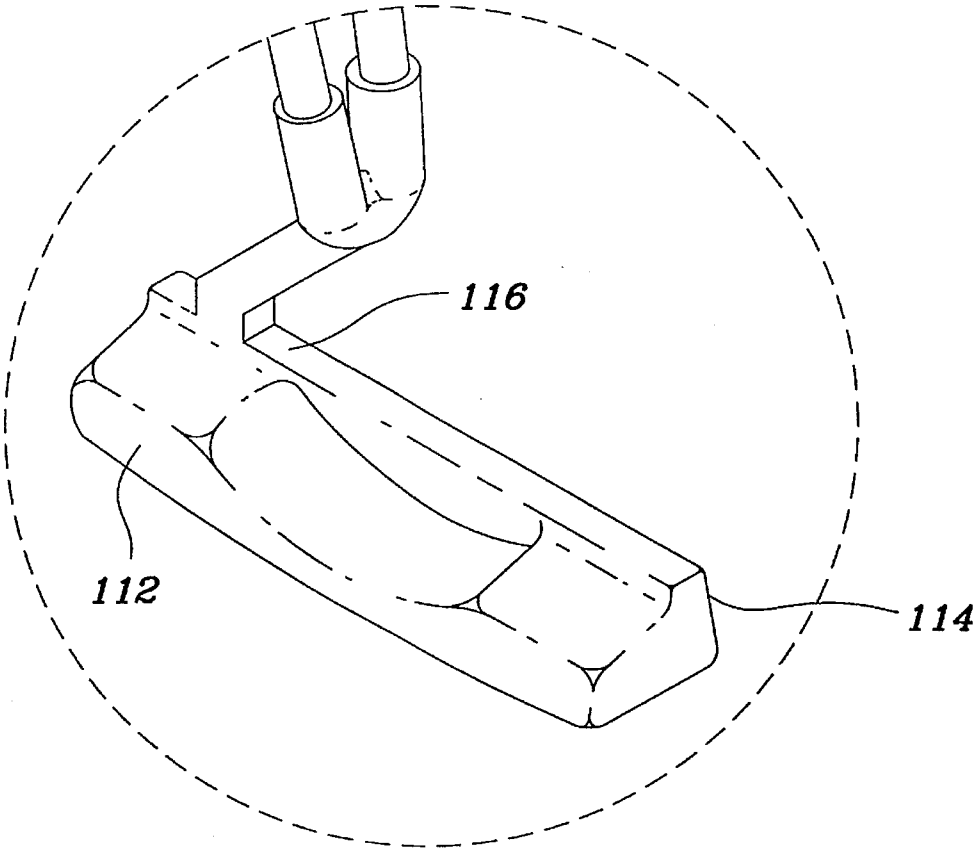
FIG. 9 is an expanded view of the putter club head shown in FIG. 3.
Figure 11:
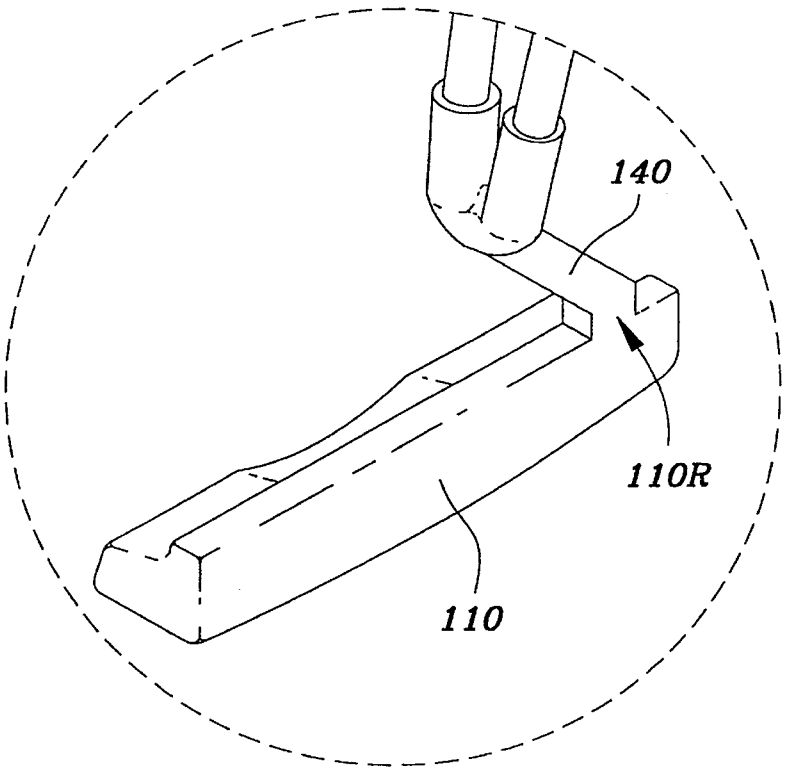
FIG. 11 is an expanded view of the putter club head shown in FIG. 5.
Figure 10:
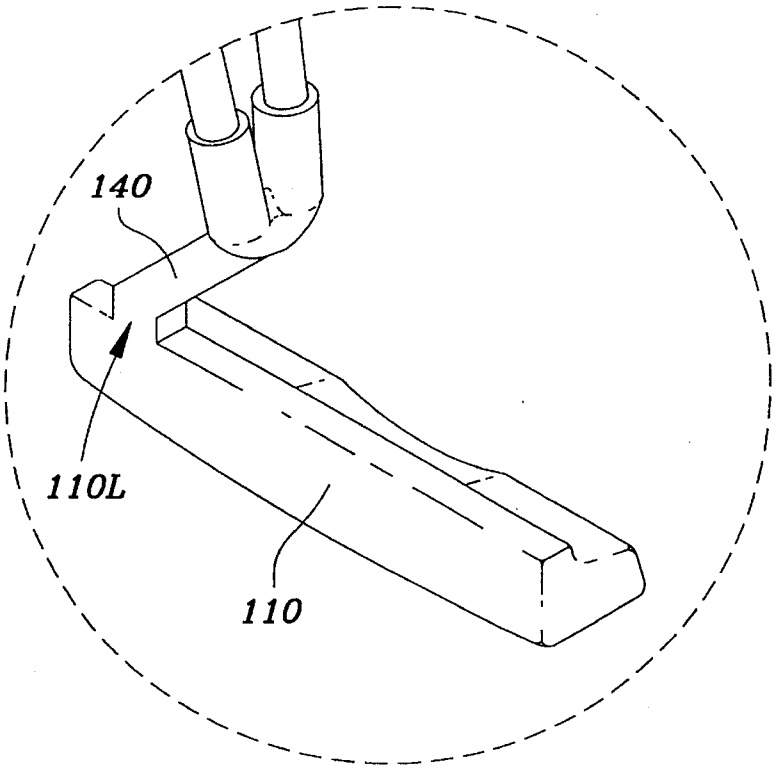
FIG. 10 is an expanded view of the putter club head shown in FIG. 4.

Referring now to FIGS. 7–9, there are shown expanded views of the putter club head 110 shown in FIGS. 1–3. Club head 110 is formed of a club heel 112, a ball striking face 114, and club head top 116. One skilled in the art would realize that the possible dimensions and configurations of putter club head 110, i.e., its design and structure, may be varied in various ways without deviation from the present invention. For instance, ball striking face 114 may be on one of two sides of the head 110, depending primarily upon whether the club to which head 110 will be attached will be used by a left-handed or right-handed golfer. Alternatively, by connecting neck 140 to the center of a "blade" type putter head having a striking face on both sides of the head, a single club design could be used for both right-handed and left-handed putting. Likewise, the material(s) from which head 110 may be constructed could be any material which may be used to construct conventional putter heads. For example, head 110 may be made of such materials as, but not limited to, brass, graphite, copper, aluminum, steel, stainless steel, ceramic, combinations of the foregoing materials, and any similar material. Moreover, head 110, neck 140 and hosels 150, 160 may be made of any one of the same materials or any desirable combination thereof. In addition, head 110, neck 140 and hosels 150, 160 may be formed as a single integral unit from a mold, or, alternatively, by the assembly of independently formed components.

In a preferred embodiment of the present invention, first hosel 150 preferably includes proximate end 150*a*, at the point where first hosel 150 is attached to neck 140, and distal end 150*b*. Likewise, second hosel 160 includes proximate end 160*a*, at the point where second hosel 160 is attached to neck 140, and distal end 160*b*. The length between proximate end 150*a* and distal end 150*b*, and length between proximate end 160*a* and distal end 160*b*, may be varied as desired and need not be equal. In the preferred embodiment, however, the distance between ends 150*a* and 150*b* is equal to the distance between ends 160*a* and 160*b*. Moreover, in the preferred embodiment, the distance between ends 150*a* and 150*b* will be approximately 1". In alternate embodiments, the distances between ends 150*a* and 150*b* (and ends 160*a* and 160*b*) may be up to 5" long, or any length necessary for the head to function as intended. The configurations of first hosel 150 and second hosel 160 are also variable but are preferably formed to function in the same manner as conventional hosels to which shafts are connected to conventional heads. More specifically, first hosel 150 and second hosel 160 are both sized and configured to accept a conventional golf club shaft. One skilled in the art would realize, however, that first hosel 150, second hosel 160, or both may be made of a size and configuration to accept unconventional shafts and/or other elements.

As attached to neck 140, first hosel 150 and second hosel 160 are preferably positioned relative to each other at an angle alpha. In the preferred embodiment, alpha is selected such that the configuration of first hosel 150 and second hosel 160 causes shafts 120, 130 to extend therefrom at the angle theta. In the embodiment shown in FIGS. 1–10, where the angle alpha is 14°, the desired angle theta between the shafts 120, 130 connected to and extending from first hosel 150 and second hosel 160 is also preferably 14°. The angle alpha could be varied to, at a minimum, fix the desired angle theta between the shafts 120, 130 within a range from 5° to 30°. In alternate embodiments, the angle alpha need not be equivalent to the desired angle theta.

The desired angle theta between the shafts 120, 130 together with the length of the shafts determines the distance between grips 170, 180. The distance, i.e., the spacing between the hands of the golfer during the stroke of the club, is preferably fixed such that the golfer tends, in the act of stroking a putt, to move primarily at the shoulders instead of at the wrist. The larger the angle theta, the farther apart grips 170, 180 are positioned relative to each other and the less inclined a golfer will be to swing a club at the wrists.

In an alternate embodiment of a two-shafted putter club according to the present invention (shown in FIG. 6), shafts 120 and 130 may be of different lengths. For example, shaft 120 may be shorter, with grip 170 lower than the elevation of grip 180. The embodiment shown in FIG. 6 might be used, for example, by a right-handed golfer to simulate on a two-shafted putter the uneven vertical positioning of the hands (i.e., left hand above the right hand) typically used when grasping a single-shafted club.

Figure 12:
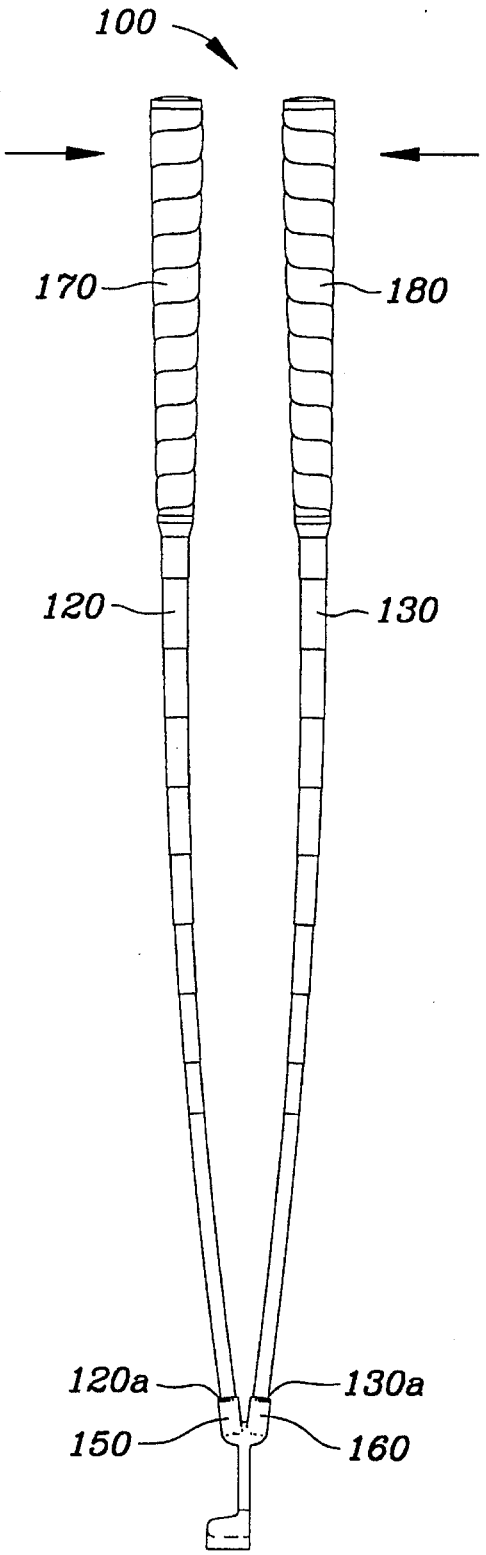
FIG. 12 is a front view of a two-shafted putter club with grips in a partially-closed position in accordance with a preferred embodiment of the present invention.
Figure 13:
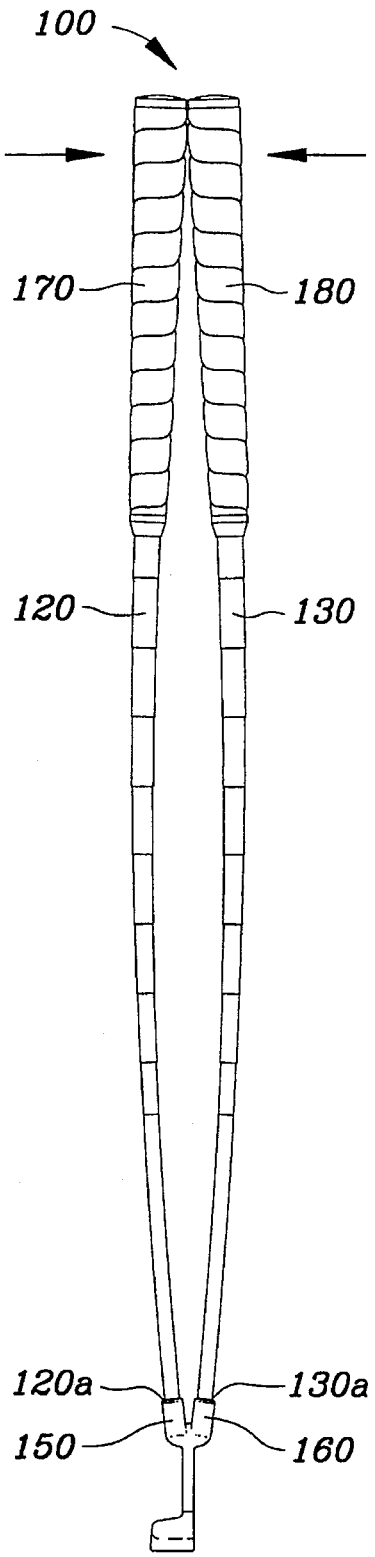
FIG. 13 is a front view of a two-shafted putter club with grips in a fully-closed position in accordance with a preferred embodiment of the present invention.

The flexibility of shafts 120 and 130 adds to the overall usefulness of the present invention. The flexibility of shafts 120 and 130 causes shafts 120 and 130 (and the angle theta) to move or vary when a golfer putting or training with club 100 begins to swing the club with the golfer's wrists, as opposed to with the golfer's shoulders. Any such movement in shafts 120 and 130 and theta during the training process provides feedback to the golfer indicating to the golfer that there is still excessive movement of the golfer's wrists during the putting stroke. Moreover, as shown in FIGS. 12 and 13, when shafts 120 and 130 have the requisite amount of flexibility (e.g., the amount of flexibility found in regular rather than stiff golf club shafts), the golfer may move the grips 170, 180 from a first "open" position (i.e., when there is no substantial external compressive force being placed on the grips) to a "partially-closed" position (shown in FIG. 12) or a "fully-closed" position (shown in FIG. 13), by applying a compressive force to the grips 170, 180 with the golfer's hands. As the golfer moves grips 170, 180 from their open to their partially-closed or closed positions, hosels 150 and 160 hold connecting ends 120*a* and 130*a* in a fixed position relative to club head 110. In the fully-closed position shown in FIG. 13, shafts 120 and 130 are substantially parallel to each other, and grips 170, 180 are in contact with each other.

The flexibility of shafts 120, 130 allows a golfer to gradually decrease the distance between his or her hands as the stroke improves. Thus, the golfer may gradually decrease the desired angle theta at his or her own pace as the golfer becomes comfortable with the feel of a proper "shoulder stroke" by applying a compressive force (in the direction shown by the arrows in FIGS. 12 and 13) to grips 170, 180 with his or her hands. As the golfer gradually decreases theta through application of this compressive force, the golfer will first bring the grips 170, 180 into a partially-closed position (FIG. 12) and then into their fully closed position (FIG. 13). As the golfer brings the grips into their fully closed position, shafts 120 and 130 will be substantially parallel and there will be only a minimum distance between the golfer's hands. The ability to position the golfer's hands closer together as the golfer's "shoulder stroke" improves, allows a golfer to use the present invention to gradually simulate a single-shafted putter, thereby training the golfer to maintain a proper stroke for use with a conventional single-shafted putter club.

The requisite amount of flexibility in shafts 120 and 130 can vary to accommodate the comfort level of individual golfers and in a manner to effectuate the desired teaching/practice effect. For example, the flexibility of shafts 120 and 130 in most cases should be stiff enough to hold the hands (at the requisite distance from each other) to encourage a putting stroke whose movement is driven by a pendulum motion at the shoulders, free of any movement of the arms and wrists. Further, shafts 120 and 130 are preferably flexible enough to allow the golfer to practice the putting stroke with grips 170, 180 in the fully-closed position shown in FIG. 13 to simulate the putting stroke of a single-shafted putter without requiring undue force or tension to develop in the arms or hands to accomplish this end.

Figure 4:
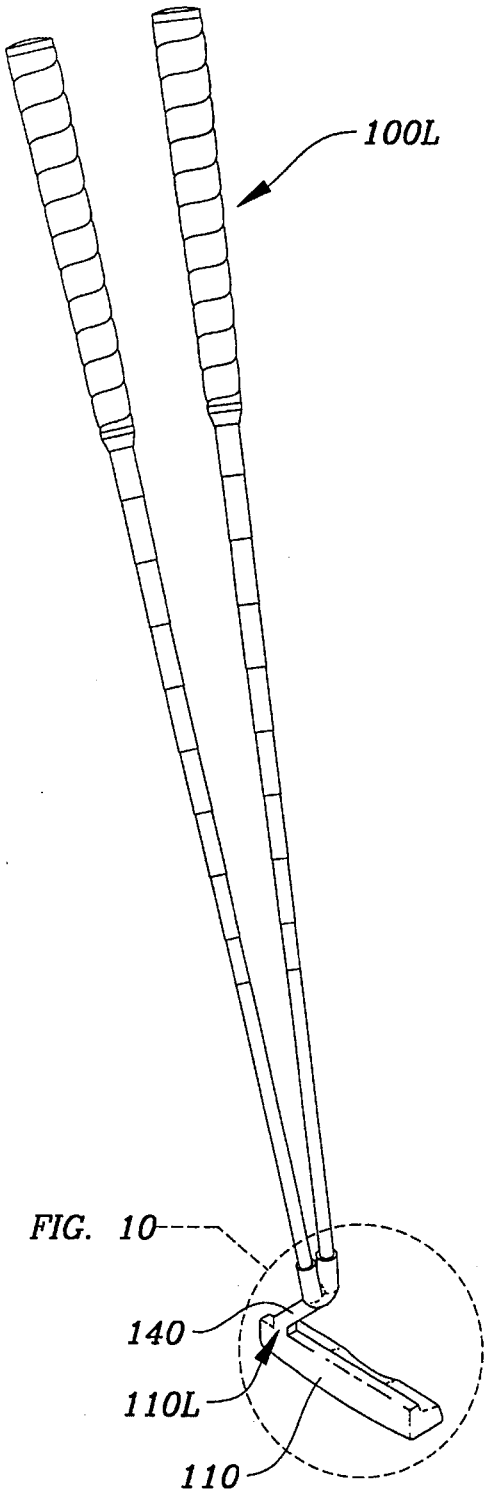
FIG. 4 is an isometric view of a left-handed two-shafted putter club in accordance with a preferred embodiment of the present invention.
Figure 5:
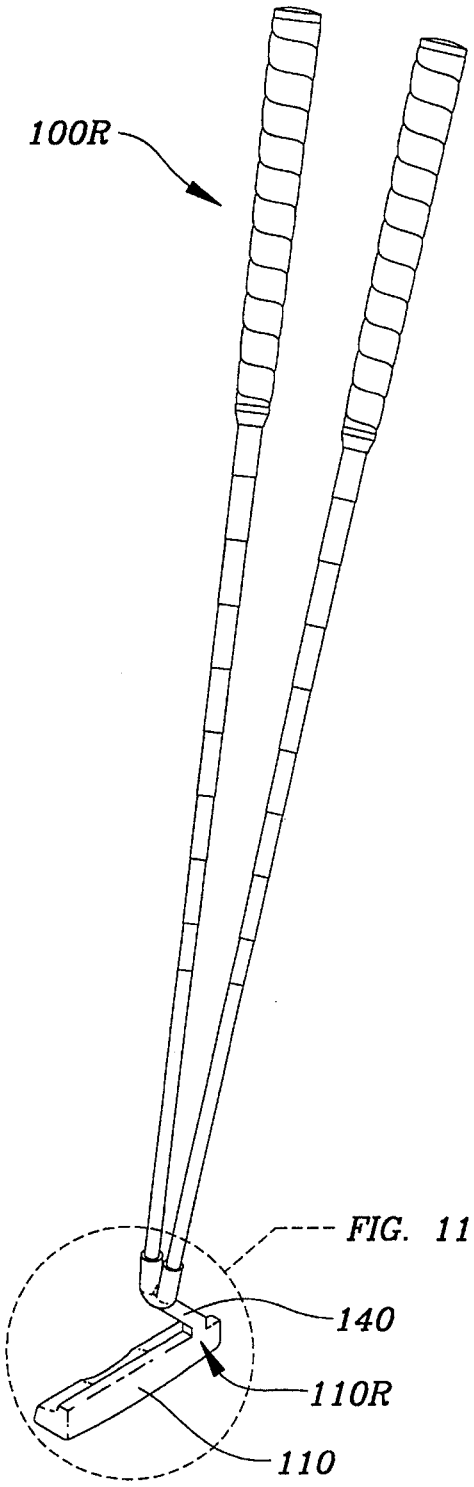
FIG. 5 is a further isometric view of a right-handed two-shafted putter club in accordance with a preferred embodiment of the present invention.
Figure 6:
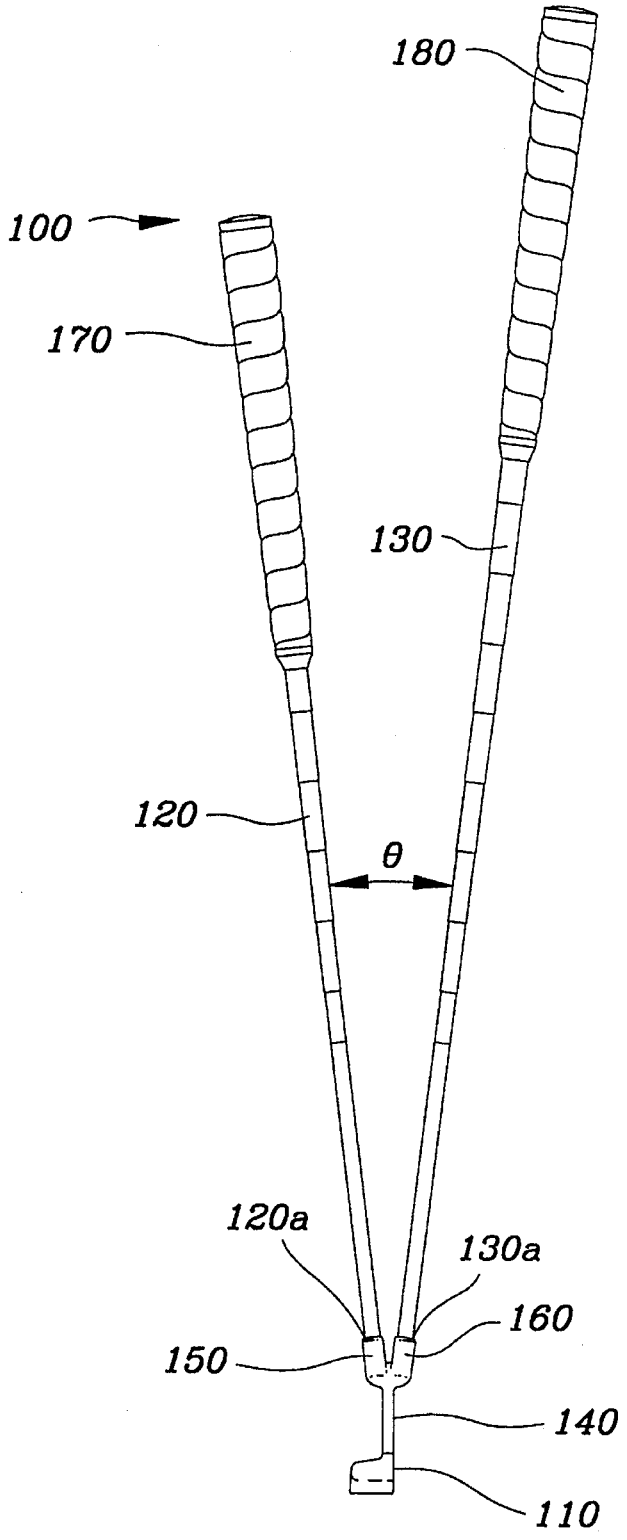
FIG. 6 is a front view of a two-shafted putter club in accordance with an alternate preferred embodiment of the present invention.

Referring now to FIGS. 4 and 5, there are shown isometric views of left-handed putter club 100L and right-handed putter club 100R in accordance with a preferred embodiment of the present invention. Right-handed putter club 100R is substantially identical to putter club 100 shown in FIGS. 1–3. Left-handed putter club 100L is the "mirror-image" of putter club 100R. Thus, although identical club heads 110 are preferably used in constructing clubs 100R and 100L, the point at which neck 140 is coupled to the club head 110 varies depending on whether a right-handed or left-handed club is being formed. More particularly, when forming left-handed putter club 100L, neck 140 is preferably coupled to head 110 at point 110L; and when forming right-handed club 100R, neck 140 is preferably coupled to head 110 at point 110R. Using a single club head 110 for both the right-handed and left-handed versions of putter club is advantageous because, among other things, a significant portion of the molds required for manufacturing can be used to form both versions of the club, thereby reducing manufacturing costs.

In a preferred embodiment of putter club 100, shaft 120 may be detachably coupled to hosel 150. For example, hosel 150 may be adapted to receive threads from connecting end 120*a* of shaft 120. In this embodiment, a golfer may detach shaft 120 from hosel 150 simply by unscrewing the shaft from the hosel. The detachment of shaft 120 from hosel 150 causes putter club 100 to be transformed from a two-shafted training putter to a single-shafted putter. Significantly, as discussed more fully in connection with FIG. 26 below, when club 100 is used as a single-shafted putter both of the golfer's hands will be positioned on grip 180 which will be "in front" of the ball at the point when the club head impacts the ball during the putting stroke.

Figure 14:
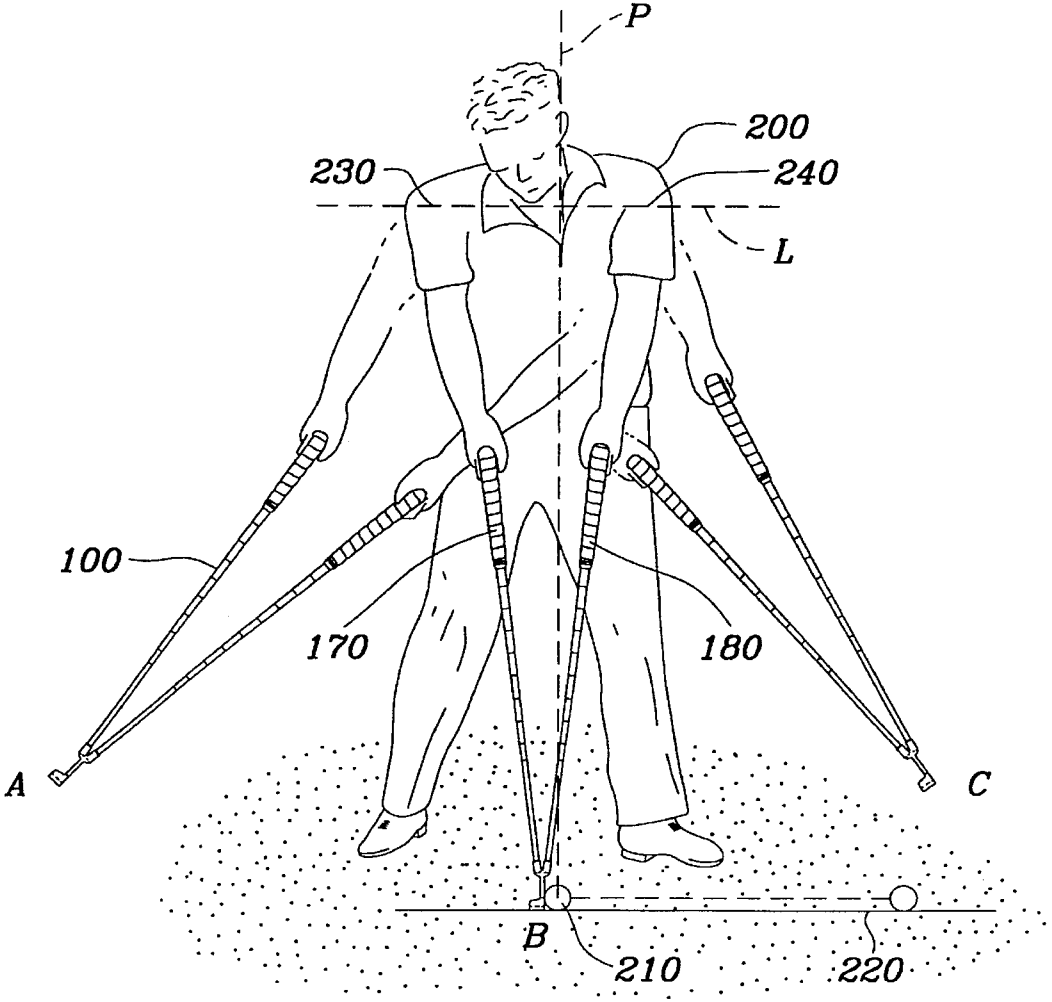
FIG. 14 is a schematic view of a golfer at three stages of a pendulum-type putting stroke using a two-shafted putter golf club in accordance with a preferred embodiment of the present invention.

Referring now to FIG. 14, there is shown a schematic view of a right-handed golfer 200 in three stages of a pendulum putting stroke using putter 100 in accordance with a preferred embodiment of the present invention. At stage "A", golfer 200 holds club 100 at the apex of a back stroke. Of course, the arc of the back stroke will depend on such factors as, for example, the distance ball 210 rests from the hole (not shown in this view), the flexibility in shafts 120 and 130, and the structure and materials used for head 110. At stage "B", club 100 comes in contact with and impacts ball 210. At the point of impact, grip 180 is preferably "in front" of ball 210 and grip 170 is preferably behind ball 210. For purposes of the present invention, grip 180 will be defined as being in front of ball 210 at the point of impact so long as grip 180 is in front of plane "P" at the point of ball impact as shown in FIG. 14. Similarly, grip 170 will be defined as being behind ball 210 at the point of ball impact so long as grip 170 is behind plane "P" at the point of impact as shown in FIG. 14. Plane "P" is perpendicular to the ground 220, passes through ball 210, and is perpendicular to a line 'L' passing through shoulders 230, 240 of golfer 200. Stage "C" shows an example of a position of golfer 200 and club 100 at the apex of a follow through of the stroke. In this particular embodiment, shafts 120 and 130 remain at a desired angle of preferably 14° throughout all stages of the stroke, however, this angle may be varied by golfer 200 by applying a desired amount of compressive force upon grips 170 and 180 before initiating the swing. Regardless of whether the golfer applies a compressive force to grips 170, 180 prior to initiating the swing, the desired angle theta preferably remains substantially constant throughout the stroke. As mentioned above, any movement or variation in the angle theta during the stroke can be easily recognized by golfer 200, thereby indicating to the golfer that there is still excessive use of the golfer's wrists during the putting stroke and causing golfer 200 to modify the golfer's stroke so that it is driven from the shoulders, and not the wrists. Typically, the desired angle theta, with golfer 200 holding grips 170 and 180 a comfortable distance apart, will depend upon the physique of golfer 200 (i.e., such factors as, for example, height, hip weight, shoulder height, shoulder width and other determining features) and the desired position of the hands of golfer 200. By keeping grips 170 and 180 in line with the shoulders of golfer 200, the arms will tend to swing from the shoulders without the wrists being unnecessarily involved in the stroking action. The stroking path therefore is more accurate because of the natural pendulum motion (i.e., stage "A" through stage "C").

The present invention further includes a method of teaching a desirable and repeatable putting form and stroke, wherein the golfer's hands are positioned a desired distance apart to facilitate a stroke driven by the shoulders, as opposed to one which may include excessive use of the golfer's wrists. This method includes the steps of (a) grasping, one in each hand, the grips 170, 180 of a two-shafted putter club 100, (b) applying a compressive force, if desired, to the grips 170, 180 to position the golfer's hands, with respect to each other, for a desired comfort and feel, and (c) while in the desired position, moving club 100 with primarily the use of the shoulders in a pendulum stroke through a desired golf ball placement location. Thus, during the stroke, the golfer's hands are positioned a desired distance apart to facilitate a stroke driven by the shoulders, as opposed to one which may include excessive use of the golfer's wrists. In some instances, no compressive force is needed to place the grips in a desired position for the golfer's hands. If the grips are not in a comfortable position for the golfer, he or she may move them to a desired position by applying a compressive force to the grips and thereby move them closer together or further apart. No force would be needed, for instance, if the grips were already in a desired position. The force applied, if any, may depend on such factors as, but not limited to, the physique of the golfer, the position of the grips relative to each other without a force applied on them and the position of the golfer's hands for the desired comfort and feel. While in the desired position, the golfer may move the club, with primarily the use of the shoulders, in a pendulum stroke through a desired golf ball placement location. By this movement, with hands apart, the golfer learns and develops the feel of a proper stroke.

In an alternative embodiment (not shown), an adjustable spacing bar may be coupled to shafts 120 and 130 slightly above ends 120*a* and 130*a* in order to impart a constant compressive or expansive force to shafts 120 and 130 during the putting stroke. In the event such a spacing bar is used, the bar should be positioned close to ends 120*a* and 130*a* such that shafts 120, 130 remain flexible when grasped at grips 170, 180.

Figure 15:
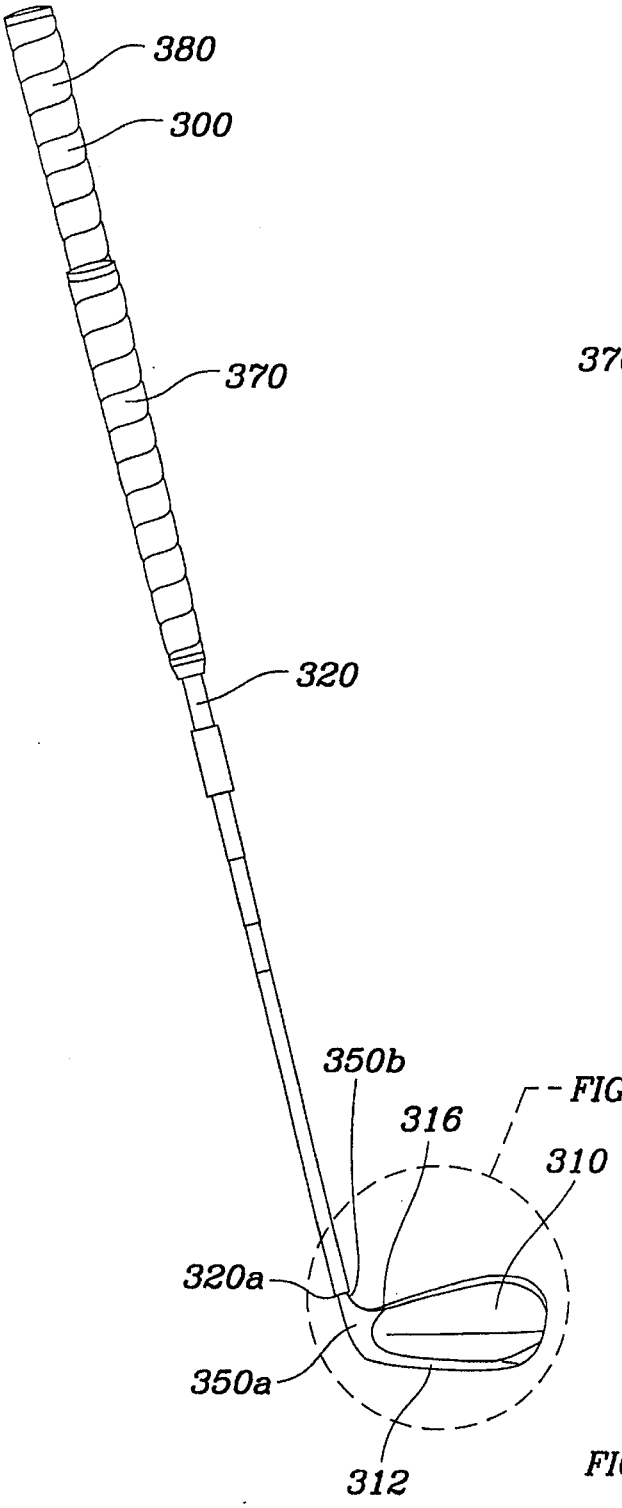
FIG. 15 is a side view of a two-shafted wedge club in accordance with a preferred embodiment of the present invention.
Figure 16:
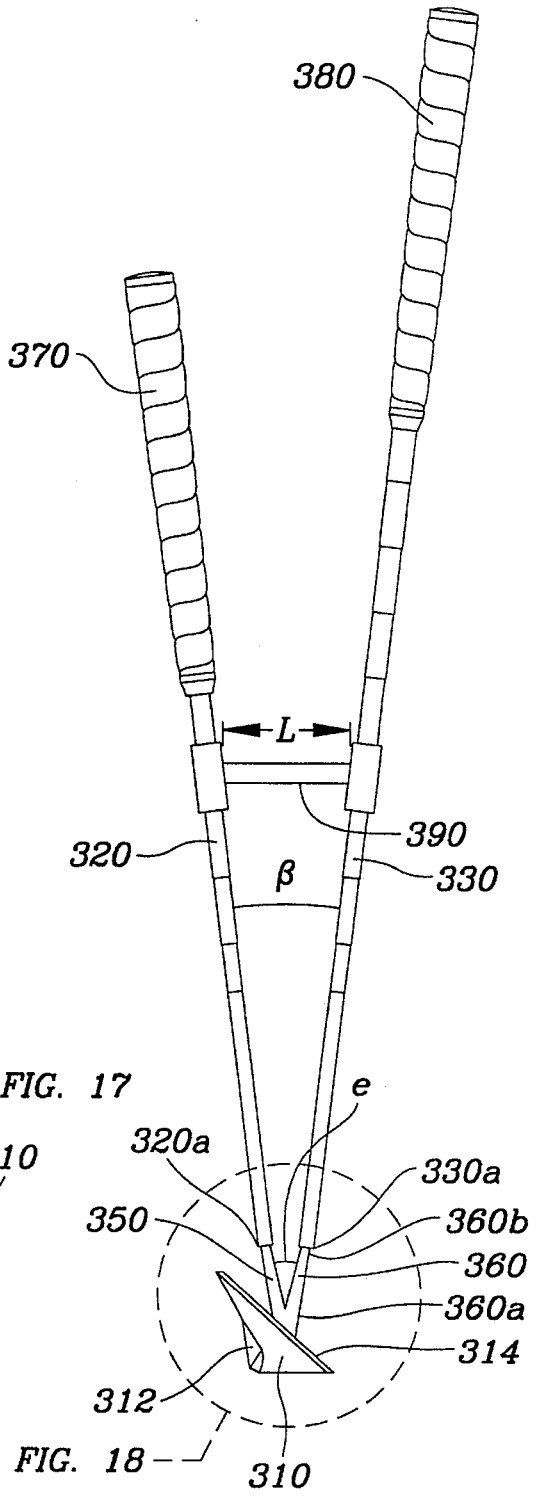
FIG. 16 is front view of a two-shafted wedge club in accordance with a preferred embodiment of the present invention.
Figure 18:
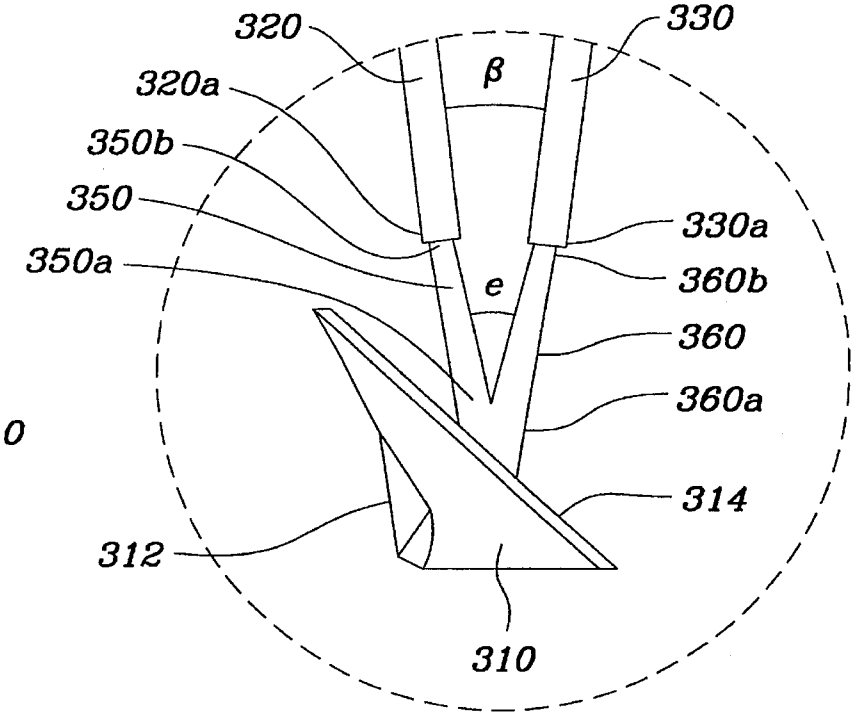
FIG. 18 is an expanded view of the wedge club head shown in FIG. 16.
Figure 17:
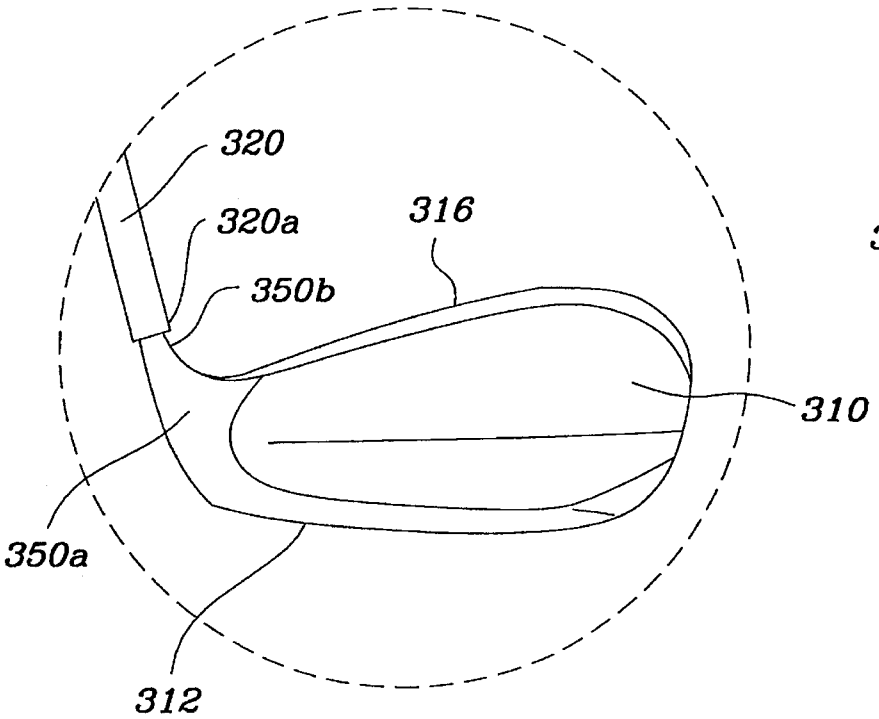
FIG. 17 is an expanded view of the wedge club head shown in FIG. 15.

Referring now to FIGS. 15 and 16, there are shown side and front views, respectively, of a two-shafted wedge club 300 in accordance with a preferred embodiment of the present invention. Wedge club 300 is formed of a wedge club head 310, and a pair of golf club shafts 320, 330. Shafts 320 and 330 are formed, for example, of conventional, flexible golf club shafts, although unconventional or specialized (e.g., curved) shafts may alternatively be used. A pair of hosels 350, 360 are rigidly affixed to an upper portion of wedge club head 310. Hosel 350 is configured to rigidly hold a connecting end 320*a* of shaft 320 in a fixed position relative to wedge club head 310. Similarly, hosel 360 is configured to rigidly hold a connecting end 330a of shaft 330 in a fixed position relative to wedge club head 310. Hosels 350 and 360 are affixed to head 310 in an angular position relative to each other such that shafts 320, 330 extend from hosels 350, 360 at a desired angle beta. The desired angle is preferably in the range of 5–30 degrees and, still more preferably, the desired angle beta will be approximately 7 degrees.

Grips 370, 380 are attached to the ends of shafts 320, 330, respectively. During the use of two-shafted wedge club 300, a golfer simultaneously grasps grip 370 with one hand and grip 380 with the other hand. The golfer then swings wedge club 300 in a pendulum motion. This preferred pendulum motion is described more fully in connection with FIG. 25. During the pendulum pitching swing, the angle beta between shafts 320, 330 remains fixed. It was found that, by repeatedly practicing a pitching swing with wedge club 300, a golfer is able to develop and maintain a constant pendulum pitching swing. Thus, as explained more fully below, a golfer may use two-shafter wedge club 300 as a training device in order to develop a pitching swing which the golfer may then use in pitching with a single-shafted wedge club. By way of example, club 300 may be used to develop a pitching swing used for chipping golf balls around the green and within 20 yards of the hole.

Referring now to FIGS. 15–18, wedge club head 310 is formed of a club heel 312, a ball striking face 314, and club head top 316. One skilled in the art would realize that the possible dimensions and configurations of wedge club head 310, i.e., its design and structure, may be varied in various ways without deviation from the present invention. For instance, ball striking face 314 may be on one of two sides of the head 310, depending primarily upon whether the club to which head 310 will be attached will be used by a left-handed or right-handed golfer. Likewise, the material(s) from which head 310 may be constructed could be any material which may be used to construct conventional pitching wedges. For example, head 310 may be made of such materials as, but not limited to, brass, graphite, copper, aluminum, steel, stainless steel, ceramic, combinations of the foregoing materials, and any similar material. Moreover, head 310 and hosels 350, 360 may be made of any one of the same materials or any desirable combination thereof. In addition, head 310, neck 140 and hosels 350, 360 may be formed as a single integral unit from a mold, or, alternatively, by the assembly of independently formed components.

In a preferred embodiment of the present invention, first hosel 350 preferably includes proximate end 350*a*, at the point where first hosel 350 merges with top 316, and distal end 350*b*. Likewise, second hosel 360 includes proximate end 360*a*, at the point where second hosel 360 merges with top 316, and distal end 360*b*. The length between proximate end 350*a* and distal end 350*b*, and length between proximate end 360*a* and distal end 360*b*, may be varied as desired and need not be equal. In the preferred embodiment, however, the distance between ends 350*a* and 350*b* is equal to the distance between ends 360*a* and 360*b*. Moreover, in the preferred embodiment, the distance between ends 350*a* and 350*b* will be approximately 1" long. In alternate embodiments, the distances between ends 350*a* and 350*b* (and ends 360*a* and 360*b*) may be up 5" long, or any length necessary for the head to function as intended. The configurations of first hosel 350 and second hosel 360 are also variable but are preferably formed to function in the same manner as conventional hosels to which shafts are connected to conventional heads. More specifically, first hosel 350 and second hosel 360 are both sized and configured to accept a conventional golf club shaft. One skilled in the art would realize, however, that first hosel 350, second hosel 360, or both may be made of a size and configuration to accept unconventional shafts and/or other elements.

As attached to the body of the golf club head 310, first hosel 350 and second hosel 360 are preferably positioned relative to each other at angle epsilon. In the preferred embodiment, epsilon is selected such that the configuration of first hosel 350 and second hosel 360 causes the shafts 320, 330 to extend therefrom at the angle beta. In the embodiment shown FIGS. 14–15, where the angle epsilon is 7°, the desired angle beta between the straight shafts 320, 330 connected to and extending from first hosel 350 and second hosel 360 is also preferably 7°. The angle epsilon could be varied to, at a minimum, fix the desired angle beta between the shafts 320, 330 within a range from 5° to 30°. In alternate embodiments, the angle epsilon need not be equivalent to the desired angle beta.

Figure 21:
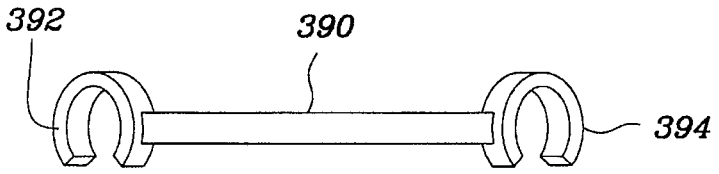
FIG. 21 is a top view of a shaft coupling brace for coupling the shafts of a two-shafted wedge club in accordance with a preferred embodiment of the present invention.
Figure 22:
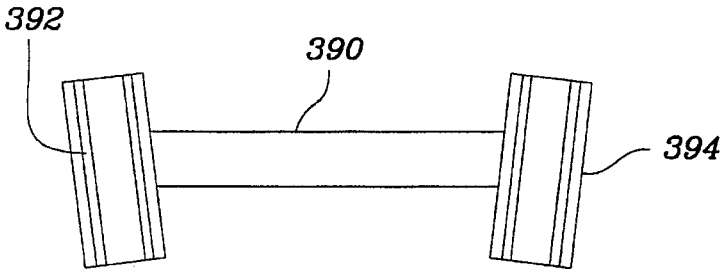
FIG. 22 is a front view of the shaft coupling brace shown in FIG. 21.
Figure 23:
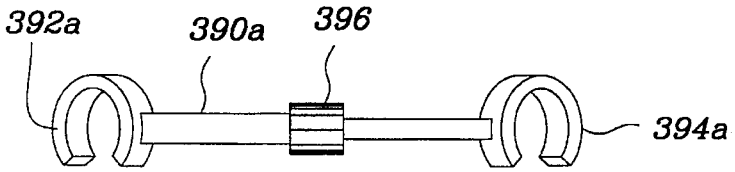
FIG. 23 is a top view of a shaft coupling brace for coupling the shafts of a two-shafted wedge club in accordance with an alternative preferred embodiment of the present invention.
Figure 24:
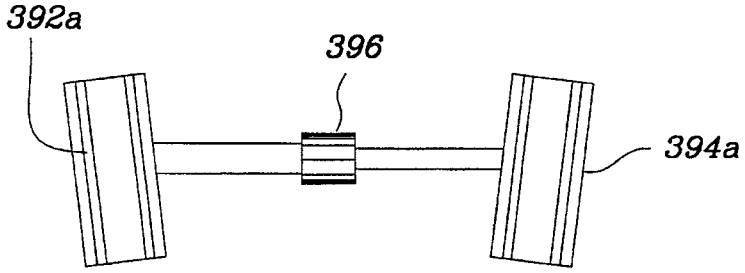
FIG. 24 is a front view of the shaft coupling brace shown in FIG. 23.

The desired angle beta between the shafts 320, 330, and their length, determines the distance between the grips 370, 380. The distance, i.e., the spacing between the hands of the golfer during the swing of the club, should be fixed such that the golfer tends, in the act of swinging club 300, to move primarily at the shoulders instead of at the wrists. The larger the angle beta, the farther apart grips 370, 380 are positioned relative to each other and the less inclined a golfer will be to swing club 300 at the wrists. In the preferred embodiment, a rigid brace 390 (shown in FIGS. 21 and 22) is affixed to shafts 320, 330 to fix the angle beta during the swinging of the club. Brace 390 may be made of such materials as, but not limited to, graphite, copper, brass, aluminum, steel, plastic, and any similar material. As shown in FIGS. 21 and 22, detachable couplers 392, 394 are preferably used for affixing brace 390 to shafts 320, 330. Brace 390 preferably has a fixed length L that fixes shafts 320, 330 at a 7° angle. In an alternate preferred embodiment, (shown in FIGS. 23 and 24), a brace 390*a* with means 396 for varying the length of the brace may be used for adjusting the angle between shafts 320, 330.

In the preferred embodiment, shafts 320 and 330 are of different lengths. In particular, in the right-handed version of wedge 300 shown in FIGS. 15 and 16, shaft 330 should be longer, with grip 380 higher than the elevation of grip 370. This preferred embodiment might be used, for example, by a right-handed golfer to simulate on a two-shafted golf club the uneven vertical positioning of the hands (i.e., left hand above the right hand) typically used when grasping a single-shafted golf club.

Figures 19, 20:
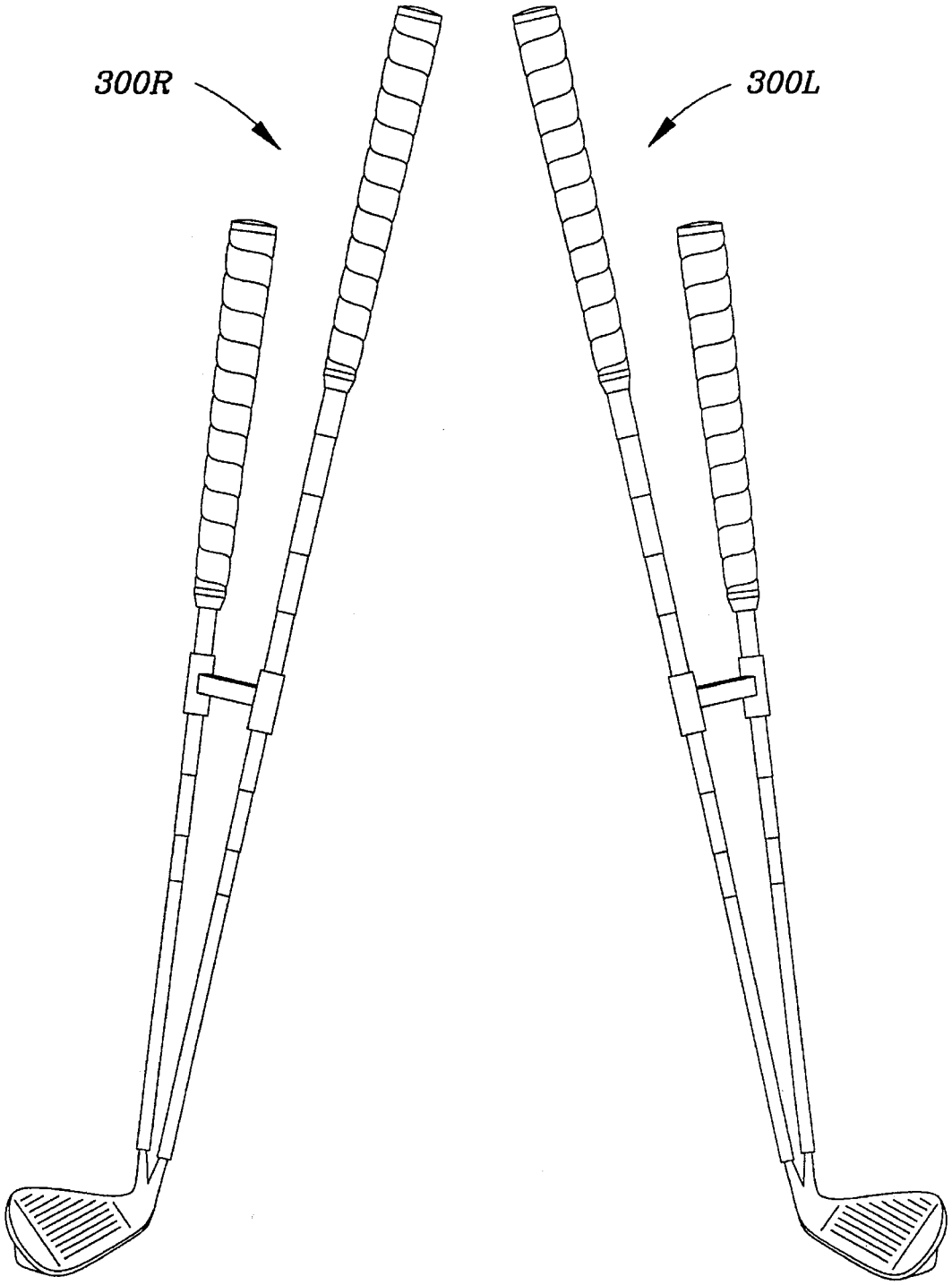
FIG. 19 is an isometric view of a right-handed two-shafted wedge club in accordance with a preferred embodiment of the present invention.
FIG. 20 is an isometric view of a left-handed two-shafted wedge club in accordance with a preferred embodiment of the present invention.

Referring now to FIGS. 19 and 20, there are shown isometric views of right-handed wedge club 300R and left-handed wedge club 300L in accordance with a preferred embodiment of the present invention. Right-handed wedge club 300R is substantially identical to club 300 shown in FIGS. 15 and 16. Left-handed wedge club 300L is the "mirror-image" of wedge club 300R.

In a preferred embodiment of wedge club 300, shaft 320 may be detachably coupled to hosel 350. For example, hosel 350 may be adapted to receive threads from connecting end 320*a* of shaft 320. In this embodiment, a golfer may detach shaft 320 from hosel 150 simply by removing brace 390 and unscrewing shaft 320 from hosel 350. The detachment of shaft 320 from hosel 350 causes wedge club 300 to be transformed from a two-shafted wedge club to a single-shafted wedge club. Significantly, as discussed more fully in connection with FIG. 26 below, when club 300 is used as a single-shafted wedge club, both of the golfer's hands will be positioned on grip 380 which will be "in front" of the ball at the point when the club head impacts the ball during the chipping swing.

Figure 25:
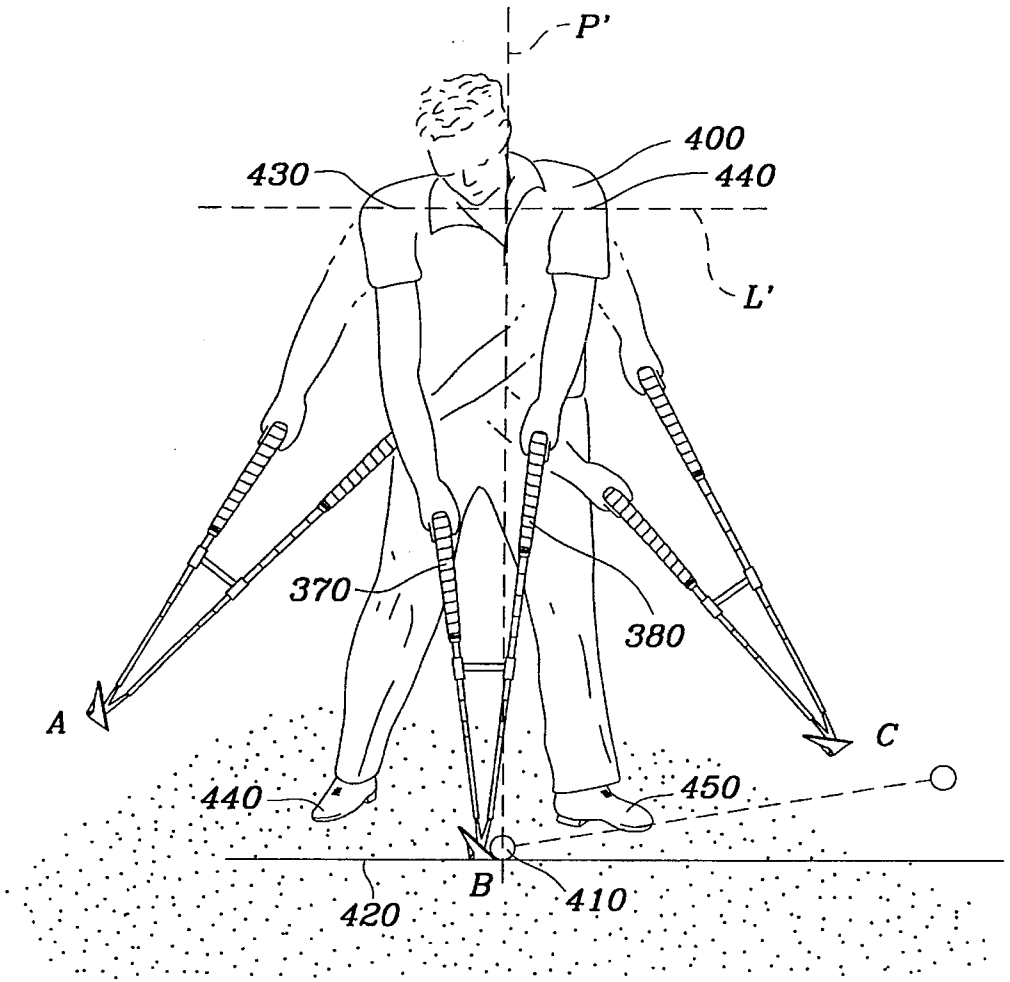
FIG. 25 is a schematic view of a golfer at three stages of a pendulum-type chipping swing using a two-shafted wedge golf club in accordance with a preferred embodiment of the present invention.

FIG. 25 shows a right-handed golfer 400 in three stages of a pendulum-shaped chipping swing using club 300 in accordance with a preferred embodiment of the present invention. At stage "A", golfer 400 holds club 300 at the apex of a back stroke. Of course, the arc of the back stroke will depend on such factors as, for example, the distance ball 410 rests from the hole (not shown in this view), the flexibility in shafts 370 and 380, and the structure and materials used for head 310. At stage "B", club 300 comes in contact with and impacts ball 410. At the point of impact, grip 380 is preferably "in front" of ball 410 and grip 370 is preferably behind ball 410. For purposes of the present invention, grip 380 will be defined as being in front of ball 410 at the point of ball impact so long as grip 380 is in front of plane "P"" at the point of ball impact as shown in FIG. 25. Similarly, grip 370 will be defined as being behind ball 410 at the point of ball impact so long as grip 370 is behind plane "P"" at the point of ball impact, as shown in FIG. 25. Plane P' is perpendicular to the ground 420, passes through ball 410, and is perpendicular to a line "L"" passing through shoulders 430, 440 of golfer 400. Stage "C" shows an example of a position of golfer 400 and club 300 at the apex of a follow through of the swing. By keeping grips 370 and 380 in line with the shoulders of golfer 400, the arms will tend to swing from the shoulders without the wrists being unnecessarily involved in the swing. The swing path therefore is more accurate because of the natural pendulum motion (i.e., stage "A" through stage "C").

Referring still to FIG. 25, a golfer 400 using wedge club 300 can vary the elevation of the trajectory of ball 410 after the point of impact by adjusting the golfer's stance (i.e., the position of front foot 450 and rear foot 440 in relation to ball 410) prior to initiating the chipping swing. More particularly, by increasing the distance between foot 450 and ball 410 (and decreasing the distance between foot 440 and ball 410) prior to initiation of the swing, golfer 400 may increase the elevation of the trajectory of ball 410 after the point of impact. Such a stance might be used, for example, when a golfer desires to chip ball 410 over the fringe of the putting green and then roll ball 410 towards the hole. Similarly, by increasing the distance between foot 440 and ball 410 (and decreasing the distance between foot 450 and ball 410) prior to initiation of the swing, golfer 400 may decrease the elevation of the trajectory of ball 410 after the point of impact. Such a stance might be used, for example, when a golfer desires to chip ball 410 a very short distance in the air and then roll ball 410 toward the hole. Regardless of the stance of feet 440, 450 in relation to ball 410 during the swing, at the point of impact with ball 410 grip 380 is still preferably in front of the plane P' defined above, and grip 370 is still preferably behind plane P'.

The present invention also includes a method of teaching a desirable and repeatable pitching swing, wherein the golfer's hands are positioned a desired distance apart to facilitate a swing driven by the shoulders, as opposed to one which may include excessive use of the golfer's wrists. The method includes the step of grasping, one in each hand, the grips of a wedge club with two shafts. The position of the grips during the use of the club should provide the desired comfort and feel. While in the desired position, the golfer may move the club, with primarily the use of the shoulders, in a pendulum stroke through a desired golf ball placement location. By this movement, with hands apart, the golfer learns and develops the feel of a proper stroke.

Although in the preferred embodiment of club 300, head 310 represents the head of a typical pitching wedge, it will be understood by those skilled in the art that a golfer may also use an iron club such as, for example, a four or five iron for chipping. Thus, in accordance with the present invention, wedge head 310 could alternatively be formed in the shape of the head of any typical iron club.

As mentioned above, in the preferred embodiment of clubs 100 and 300, these two-shafted clubs may be transformed into a single-shafted club by detaching (or unscrewing) one of the shafts from a hosel coupled to the club head.

Figure 26:
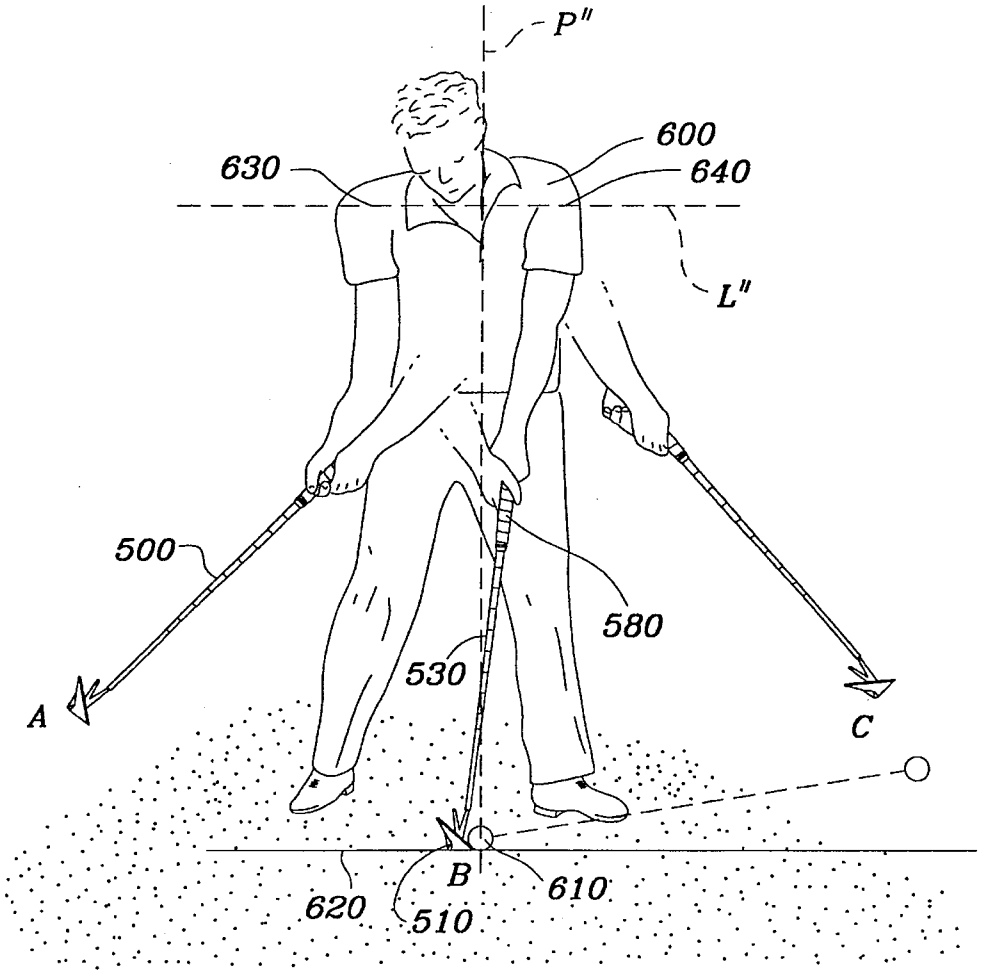
FIG. 26 is a schematic view of a golfer at three stages of a pendulum-type swing using a single-shafted golf club in accordance with a further preferred embodiment of the present invention.

In FIG. 26, there is shown a schematic view of a golfer 600 at three stages of a pendulum-type swing using a single-shafted golf club 500 in accordance with a further preferred embodiment of the present invention. Single-shafted club 500 may be formed, for example, by detaching a shaft from a two-shafted putter or wedge club. As explained more fully below, shaft 530 is angle relative to club head 510 such both of the golfer's hands are positioned on a grip 580 which is "in front" of ball 610 at the point when club head 510 impacts ball 610 during the swing.

Referring still to FIG. 26, at stage "A", golfer 600 holds club 500 at the apex of a back stroke. Golfer 600 preferably grasps club 500 with both hands by grasping grip 580 with a conventional two-handed golfer's grip. At stage "B", club 500 comes in contact with and impacts ball 610. At the point of impact, grip 580 and both of the golfer's hands are preferably "in front" of ball 610. For purposes of the present invention, grip 580 will be defined as being in front of ball 610 at the point of ball impact so long as grip 580 is in front of plane "P"" at the point of ball impact as shown in FIG. 26. Plane P" is perpendicular to the ground 620, passes through ball 610, and is perpendicular to a line "L"⇆ passing through shoulders 630, 640 of golfer 600. Stage "C" shows an example of a position of golfer 600 and club 500 at the apex of a follow through of the swing.

The above embodiments are merely illustrations of the apparatus claimed herein. The invention also includes other embodiments not specifically disclosed above, embodiments which one skilled in the art would realize and envision as equivalents or derivations of the embodiments shown and existing in other specific forms without departing from its spirit or essential attribution. Numerous variations may be made within the scope of this invention without departing from the principle of the invention and without sacrificing its chief advantages. Thus, the terms and expressions have been used as terms of description and not terms of limitation. Instead, reference should be made to the appended claims, rather than to the foregoing specification and drawings, as indicating the scope of the apparatus invention.

What is claimed is:

1. A golf putter club for training a golfer to repeatedly putt a golf ball using a constant putting stroke, said golfer having a pair of shoulders and first and second hands, said constant putting stroke being defined by movement of said shoulders of said golfer in a pendulum motion, comprising:

(A) a putter head body having a heel, a top and a ball striking face, said ball striking face being formed of a flat surface lying in a first plane;

(B) a connecting neck rigidly affixed to said top for rigidly coupling first and second hosels to said putter head body;

(C) a first hosel having a first proximate end attached to said neck and a second opposing end sized and configured to rigidly hold a connecting end of a first shaft in a fixed position relative to said putter head body;

(D) a second hosel having a first proximate end attached to said neck and a second opposing end sized and configured and rigidly holding a connecting end of a second shaft in a fixed position relative to said putter head body, said first and second shafts lying in a second plane that is perpendicular to said first plane; and wherein said first and second hosels are angled relative to each other such that said first and second shafts extend therefrom with a desired angle that helps train said golfer to repeatedly putt using said constant putting stroke when said first and second shafts are simultaneously and respectively gripped by said first and second hands of said golfer, said desired angle being less than 180 degrees and remaining substantially fixed during said putting stroke.

2. The putter recited in claim 1, wherein said first and second shafts are flexible golf club shafts.

3. The putter recited in claim 1, wherein said desired angle is in the range of from 5° to 30°, when said first and second shafts are free of external forces acting thereon.

4. The putter recited in claim 3, wherein said desired angle is fourteen degrees.

5. The putter recited in claim 1, said first shaft having a gripping end opposite said connecting end of said first shaft, said second shaft having a gripping end opposite said connecting end of said second shaft, wherein said golfer, by applying a compressive force to said gripping ends of said first and second shafts, may move said gripping ends of said first and second shafts from a first position, relative to each other, to a second position while the first and second hosels respectively hold said connecting ends of said first and second shafts in a fixed position.

6. The putter as recited in claim 5, wherein in said second position said first and second shafts are substantially parallel to each other.

7. The putter recited in claim 1, wherein said first shaft is angled relative to said ball striking face such that said first hand of said golfer is positioned in front of said golf ball when said ball striking face impacts said golf ball during said putting stroke.

8. The putter recited in claim 7, wherein said second shaft is detachably coupled to said second hosel.

9. The putter recited in claim 1, wherein said first shaft is longer than said second shaft.

10. A method for training a golfer to repeatedly putt a golf ball using a constant putting stroke, said golfer having a pair of shoulders, first and second arms, first and second wrists, and first and second hands, said first wrist connecting said first arm and said first hand at a first wrist angle, said second wrist connecting said second arm and said second hand of a second wrist angle, said constant putting stroke being defined by movement of said shoulders of said golfer in a pendulum motion and an absence of angular movement in said first and second wrist angles during said pendulum motion, comprising the steps of:

(A) simultaneously grasping a first grip of a putter club with said first hand and a second grip of said putter club with said second hand, said putter club having a first flexible shaft with first and second ends, said first end of said first flexible shaft having said first grip, said second end of said first flexible shaft being rigidly connected to a first hosel affixed to a neck of said putter club such that said second end of said first flexible shaft is held in a fixed position relative to said neck, said putter club having a second flexible shaft with first and second ends, said first end of said second flexible shaft having said second grip, said second end of said second flexible shaft being rigidly connected to a second hosel affixed to said neck such that said second end of said second flexible shaft is held in a fixed position relative to said neck, said neck being rigidly affixed to a top side of a head of said putter club;

(B) positioning with said first and second hands said first and second grips such that said first and second hands are in a desired position for comfort and feel, said first and second flexible shafts being a desired distance apart and at a desired angle with respect to each other when said first and second grips are positioned in said desired position, said desired angle being less than 180 degrees; and (C) while said desired angle and said desired distance remain substantially fixed, moving said head of said putter club through a desired golf bail placement location with said constant putting stroke;

wherein said first and second flexible shafts each have a flexibility which is sufficiently rigid to hold said desired angle fixed during said moving step so long as said golfer uses said constant putting stroke to swing said putter club, said flexibility being insufficiently rigid to hold said desired angle fixed when said golfer varies one or both of said first and second wrist angles during said moving step.

11. The method recited in claim 10, wherein said head impacts said golf ball at said desired golf ball placement location during said moving step, and wherein at least one of said hands is positioned ahead of said golf ball when said head impacts said golf ball.

12. The method recited in claim 11, wherein said positioning step further includes applying a compressive force to said first and second grips with said first and second hands so as to contract said desired angle and said desired distance prior to said moving step;

whereby said first and second hands are positioned so as to simulate a single-shafted putter grip prior to said moving step.

13. The method recited in claim 10, wherein said first shaft is longer than said second shaft.

* * * * *